US008100690B2

(12) United States Patent
Mortensen et al.

(10) Patent No.: US 8,100,690 B2
(45) Date of Patent: Jan. 24, 2012

(54) METHOD AND COOLER FOR COOLING HOT PARTICULATE MATERIAL

(75) Inventors: Sten Mortensen, Værlöse (DK); Mogens Juhl Föns, Fårup (DK)

(73) Assignee: Flsmidth A/S, Valby (SE)

( * ) Notice: Subject to any disclaimer, the term of this patent is extended or adjusted under 35 U.S.C. 154(b) by 897 days.

(21) Appl. No.: 11/631,407

(22) PCT Filed: Jun. 10, 2005
(Under 37 CFR 1.47)

(86) PCT No.: PCT/IB2005/001723

§ 371 (c)(1),
(2), (4) Date: Jan. 3, 2007

(87) PCT Pub. No.: WO2006/005997

PCT Pub. Date: Jan. 19, 2006

(65) Prior Publication Data

US 2008/0283226 A1 Nov. 20, 2008

(30) Foreign Application Priority Data

Jul. 2, 2004 (DK) ..... 2004 01047

(51) Int. Cl.
*F27D 15/02* (2006.01)

(52) U.S. Cl. ..... 432/77; 432/78

(58) Field of Classification Search ..... 165/38; 209/142, 660; 432/14, 77, 78, 80; 236/12.1, 236/12.17, 23
See application file for complete search history.

(56) References Cited

U.S. PATENT DOCUMENTS

| | | | | | |
|---|---|---|---|---|---|
| 4,280,418 | A * | 7/1981 | Erhard | 110/347 |
| 4,762,489 | A * | 8/1988 | Schmits et al. | 432/77 |
| 4,955,296 | A * | 9/1990 | Barlow | 110/300 |
| 5,044,288 | A * | 9/1991 | Barlow | 110/346 |
| 5,201,652 | A | 4/1993 | Kawamura et al. | |
| 5,759,026 | A * | 6/1998 | von Wedel | 432/77 |
| 5,871,348 | A | 2/1999 | Terry et al. | |
| 6,082,021 | A * | 7/2000 | Fons et al. | 34/364 |
| 6,405,661 | B1 * | 6/2002 | Mancini et al. | 110/341 |
| 6,513,445 | B1 * | 2/2003 | Forsberg et al. | 110/298 |
| 2004/0115581 | A1 * | 6/2004 | Meyer et al. | 432/77 |

FOREIGN PATENT DOCUMENTS

| | | | |
|---|---|---|---|
| GB | 1006444 | A | 10/1965 |
| JP | 03197339 | | 8/1991 |
| JP | 3271142 | A | 12/1991 |
| JP | 2001012864 | A * | 1/2001 |

OTHER PUBLICATIONS

Japanese Office Action for corresponding Japanese application dated Nov. 8, 2010. Translation of JP571406548 in Japanese Office Action dated Nov. 8, 2010.

* cited by examiner

*Primary Examiner* — Gregory A Wilson
(74) *Attorney, Agent, or Firm* — Jeffrey S. Melcher; Manelli Selter PLLC

(57) ABSTRACT

Described is a method as well as a cooler (1) for cooling hot particulate material which has been the subject of heat treatment in an industrial furnace, such as a rotary kiln (3) for manufacturing cement clinker, by which method the hot material from the kiln (3) is directed to an inlet grate (21) in the cooler (1), in which cooling air from an underlying compartment (24) is led via a number of channels (28) through gaps (20) in the inlet grate for cooling the hot material and where compressed air from a separate system (25) via a number of ducts (26) can be intermittently injected into the material on the inlet grate (21). The channels (28) for cooling air are blanked off in connection with the injection of compressed air.

8 Claims, 1 Drawing Sheet

1
2
3
4
5
11
12
13
14
20
21
22
23
24
25
26
27
28

METHOD AND COOLER FOR COOLING HOT PARTICULATE MATERIAL

CROSS-REFERENCE TO RELATED APPLICATIONS

This application is a national stage entry under 35 U.S.C. 371 of International Application No. PCT/IB2005/001723, filed 10 Jun. 2005, designating the United States. This application claims foreign priority under 35 U.S.C. 119 and 365 to Denmark Patent Application No. PA200401047, filed 2 Jul. 2004.

BACKGROUND OF THE INVENTION

The present invention relates to a method for cooling hot particulate material which has been subjected to heat treatment in an industrial furnace, such as a rotary kiln for manufacturing cement clinker, by which method the hot material from the kiln is directed to an inlet grate in a cooler, in which cooling air from an underlying compartment is led via a number of channels through gaps in the inlet grate for cooling the hot material and where compressed air from a separate system via a number of ducts can be intermittently injected into the material on the inlet grate. The invention also relates to a cooler for carrying out the method.

A cooler of the aforementioned kind is known from EP 0 780 651 in which compressed air at a pressure of more than 345 kPa is intermittently injected in a substantially horizontal manner into the material on the grate so as to dislodge any agglomerates and so-called snowmen formations formed by the agglutination of clinker material, and resulting in reduced performance efficiency of the cooler. The disadvantage of this known cooler is that large snowmen formations and agglomerations which may weigh up to several tons cannot be completely removed or pushed along in the cooler by means of injections in the horizontal direction of movement of the material. For this known cooler it may be possible to reduce the extent of snowmen formations, but it will not be possible to achieve complete elimination of such formations. For this known cooler there is also a risk of clinker dust by the compressed air being blown through the grates and down into the underlying system of ducts.

SUMMARY OF THE INVENTION

It is the object of the present invention to provide a method as well as a cooler for cooling hot particulate material by means of which the aforementioned disadvantages are eliminated.

This is achieved by a cooler of the kind mentioned in the introduction and being characterized in that the channels for cooling air are blanked off in connection with the injection of compressed air.

Hereby is obtained an effective removal of agglomerates and snowmen formations from the inlet grate. This is due to the resulting increase in the static pressure between the cooling grate and the bed of material which will allow the compressed air to transiently form an air cushion which will lift the material off the grate, causing snowmen formations and other large agglomerations of material to lose their grip on the grate, diverting them down through the cooler. Given that the cooling air channels are blanked off, any fall-through of clinker dust into the underlying compartment will also be prevented.

In principle, the compressed air may be injected into the material using any appropriate means. The compressed air may thus be injected through separate nozzle openings which are provided evenly distributed across the inlet grate, and they direct the compressed air into the material at any angle relative to the inlet grate, but preferably at an angle between 0 and 90°. However, it is preferred that the compressed air is directed through the cooling air gaps in the inlet grate to prevent a backflow of air stream containing clinker dust through the grate.

The cooler for carrying out the method according to the invention comprises an inlet grate for receiving and supporting hot material from a kiln, an underlying compartment which via a number of cooling air channels is connected to gaps in the inlet grate for introducing cooling air into the hot material and a separate compressed air system comprising a number of ducts for injecting compressed air into the material on the inlet grate, and being characterized in that it comprises means for blanking off the cooling air channels.

It is further preferred that the cooler comprises also means for blanking off the compressed air ducts.

The blanking-off means for cooling air channels as well as the compressed-air ducts may be made up of any appropriate means such as ball valves and similar devices. However, it is preferred that the blanking-off means are made up of a number of dampers capable of being moved between two extreme positions, ensuring in one extreme position that the respective compressed-air duct is blanked off while the corresponding cooling air channel is open, and ensuring in the other extreme position that the respective cooling air channel is blanked off while the corresponding compressed-air duct is open. It is further preferred that the dampers are configured as tilting dampers being capable of tilting about an axis and movable between the extreme positions by means of the cooling air and the compressed air, respectively.

The inlet grate may be formed in any appropriate way. It may thus be of a stepped configuration or a substantially plane configuration. It is preferred that the inlet grate is configured with an inclination in the direction of movement of the material in order to promote the movement of the material through the cooler.

BRIEF DESCRIPTION OF THE DRAWINGS

The invention will be explained in further details in the following with reference to the drawing which is diagrammatical and where.

DETAILED DESCRIPTION OF THE INVENTION

Figures 1, 2, 3:
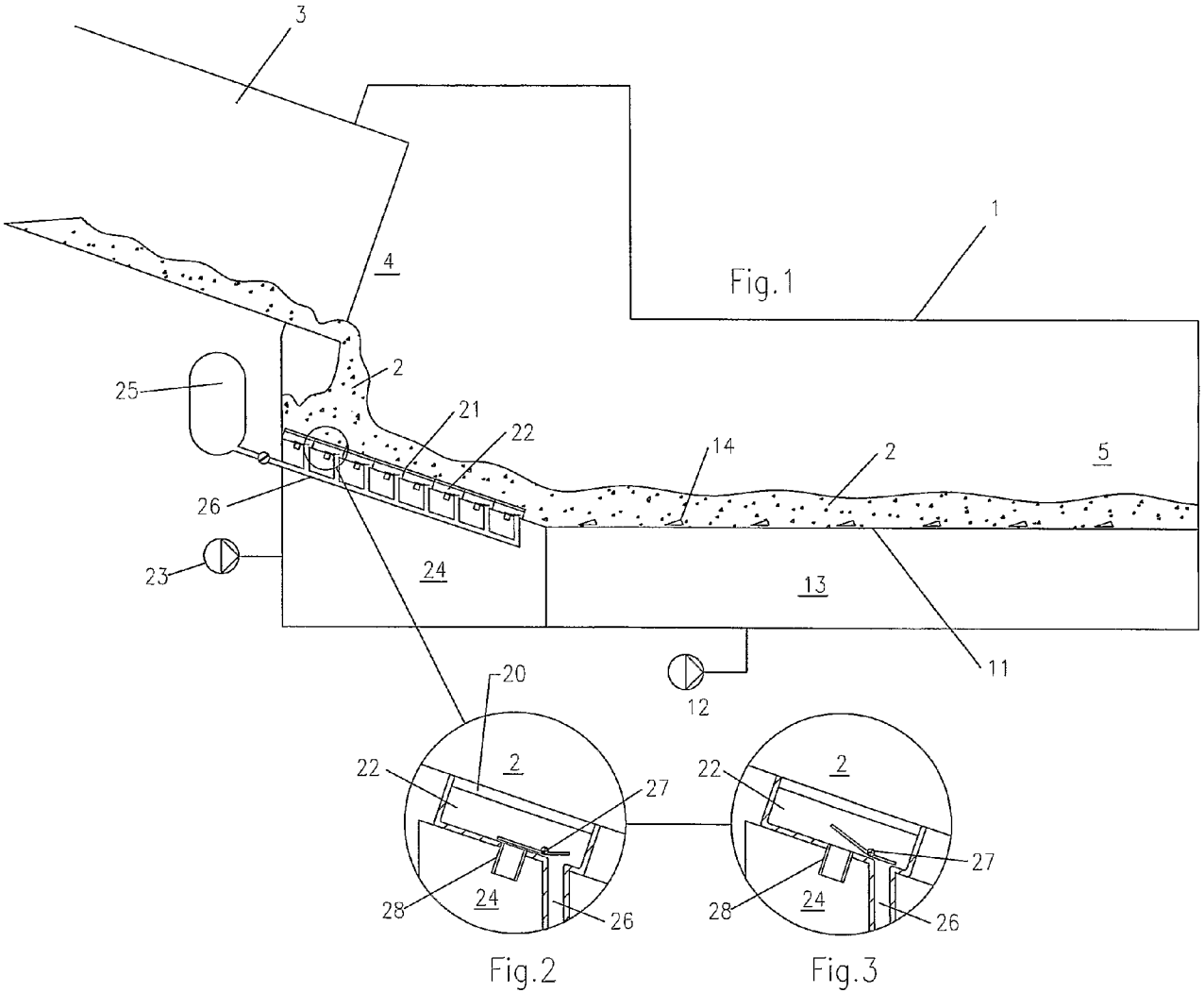
FIG. 1 shows a side view of a cooler according to the invention.
FIGS. 2 and 3 show a sectional view of the cooler shown in FIG. 1 in two modes of operation.

In FIG. 1 is seen a cooler 1 which is installed in direct extension of a rotary kiln 3 for manufacturing cement clinker. The cooler comprises an inlet end 4 and an outlet end 5. The cooler shown also comprises a stationary grate bottom 11 for supporting the cement clinker, a pressurizing fan 12 for injecting cooling gas up through the clinker via a compartment 13 and gaps, not shown in details, in the inlet grate 11 and a row of scraper elements 14 which by means of a not shown driving apparatus can be moved back and forth in the longitudinal direction of the cooler, thereby moving the clinker from the inlet end of the cooler to its outlet end.

The cooler shown also comprises an inlet grate 21 which is located at the inlet end 4 of the cooler immediately below the outlet end of the rotary kiln for receiving the hot cement clinker 2. The configuration per se of the inlet grate is without the scope of the present invention, and in principle, it may be configured in any appropriate way. The as an example shown inlet grate 21 is substantially plane and comprises a number of grate shoes 22. The inlet grate is fitted with a certain inclination relative to the horizontal plane in order to promote the movement of the clinker through the cooler. In the inlet section the cooler also comprises a pressurizing fan 23 for injecting cooling gas through the clinker via a compartment 24, cooling air channels 28 and gaps (20), not shown in details, in the inlet grate 22, as well as a separate compressed air system comprising a compressed air tank 25 and a number of ducts 26 for injecting compressed air into the material on the inlet grate. The compressed air tank 25 may in an alternative embodiment be composed of a pressurizing fan.

As illustrated in FIGS. 2 and 3 the cooler according to the invention also comprises means 27 for blanking off the cooling air channels 28 in connection with the injection of compressed air into the clinker. The blanking-off means are substantially made up of tilting dampers 27 which are configured so that by means of the cooling air and the compressed air, respectively, they can be moved between two extreme positions, where in one extreme position they blank off the respective compressed-air duct 26, while the corresponding cooling air channel is open, as shown in FIG. 3 and so that in the second extreme position they blank off the respective cooling air channel 28, while the corresponding compressed-air duct 26 is open, as shown in FIG. 2.

During the normal operation of the cooler, the compressed-air system is closed by means of a valve, such as a solenoid valve, with the tilting dampers 27 assuming the position indicated in FIG. 3. At intervals, the length of which may be predetermined or determined in dependence of the prevailing operating situation, the compressed-air system is opened, causing the tilting dampers to move to the position indicated in FIG. 2, in which they will shut off the respective cooling air channel 28. Hence the compressed air will be led through the grate shoes 22 and towards the clinker layer 2 thereby increasing the static pressure between the inlet grate 21 and the clinker bed 2, thereby transiently forming an air cushion which will lift the material off the grate. Snowmen formations and other major material agglomerations will also be lifted off the inlet grate and will continue their migration down through the cooler. It may also be desirable to inject compressed air only at predefined areas of the inlet grate and the cooler may therefore comprise a valve (not shown), such as a solenoid valve, in each compressed air duct 26 connected to the grate.

The invention claimed is:

1. Method for cooling hot particulate material which has been subjected to heat treatment in an industrial furnace for manufacturing cement clinker, the method comprising:

directing hot material from a kiln to an inlet grate in a cooler, in which cooling air from an underlying compartment is fed into via a number of channels through gaps in the inlet grate for cooling the hot material; and intermittently injecting compressed air from a separate system via a number of ducts into the material on the inlet grate, wherein the channels for cooling air are shut off when the compressed air is injected into the material.

2. Method according to claim 1, wherein the compressed air is directed through the cooling air gaps in the inlet grate.

3. Method according to claim 1, wherein when the compressed air is injected into the material a static pressure between the inlet grate and a clinker bed to transiently forming an air cushion that lifts the material along with any snowmen formations or other material agglomerations off of the inlet grate.

4. Cooler comprising:

an inlet grate for receiving and supporting hot material from a kiln;

an underlying compartment which via a number of cooling air channels is connected to gaps in the inlet grate for introducing cooling air into the hot material;

a separate compressed air system comprising a number of compressed-air ducts and means for shutting off the compressed air-ducts, the compressed air-ducts being constructed for intermittently injecting compressed air through the cooling air gaps into the material on the inlet grate; and means for shutting off the cooling air channels when compressed air is supplied to the inlet grate.

5. A cooler according to claim 4, further comprising a compressed air tank connected to the compressed-air ducts.

6. Cooler comprising:

an inlet grate for receiving and supporting hot material from a kiln;

an underlying compartment which via a number of cooling air channels is connected to gaps in the inlet grate for introducing cooling air into the hot material;

a separate compressed air system comprising a number of compressed-air ducts for injecting compressed air through the cooling air gaps into the material on the inlet grate; and tilting dampers being capable of tilting about an axis between two extreme positions, in a first extreme position the cooling air is supplied to the cooler and the compressed air is shut off and in a second extreme position the cooling air is shut off and the compressed air is supplied to the cooler.

7. Method for cooling hot particulate material which has been subjected to heat treatment in an industrial furnace for manufacturing cement clinker, the method comprising:

directing hot material from a kiln to an inlet grate in a cooler, in which cooling air from an underlying compartment is fed into via a number of channels through gaps in the inlet grate for cooling the hot material; and intermittently injecting compressed air from a separate system via a number of ducts into the material on the inlet grate, wherein the channels for cooling air are shut off when the compressed air is injected into the material using a tilting damper constructed and arranged such that in a first extreme position the compressed air is shut off and cooling air is allowed to flow into the cooler and in a second extreme position the compressed air is allowed to flow into the cooler and the flow of cooling air to the cooler is shut off.

8. Method according to claim 7, wherein when the compressed air is injected into the material a static pressure between the inlet grate and a clinker bed to transiently forming an air cushion that lifts the material along with any snowmen formations or other material agglomerations off of the inlet grate.

* * * * *